United States Patent [19]

Blizzard

[11] Patent Number: 4,660,646

[45] Date of Patent: Apr. 28, 1987

[54] FAILSAFE GAS CLOSED SAFETY VALVE

[75] Inventor: William A. Blizzard, Houston, Tex.

[73] Assignee: Camco, Incorporated, Houston, Tex.

[21] Appl. No.: 802,656

[22] Filed: Nov. 27, 1985

[51] Int. Cl.[4] ..... E21B 34/10

[52] U.S. Cl. ..... 166/321; 166/324; 251/62

[58] Field of Search ..... 166/319, 320, 321, 324, 166/332, 334, 386, 72; 251/62

[56] References Cited

U.S. PATENT DOCUMENTS

| | | | |
|---|---|---|---|
| 3,071,151 | 1/1963 | Sizer | 166/324 X |
| 3,782,461 | 1/1974 | Watkins | 166/72 |
| 4,069,871 | 1/1978 | Page, Jr. | 166/321 |
| 4,144,937 | 3/1979 | Jackson et al. | 166/332 X |
| 4,161,219 | 7/1979 | Pringle | 166/324 |
| 4,252,197 | 2/1981 | Pringle | 166/324 X |
| 4,373,587 | 2/1983 | Pringle | 166/324 |
| 4,503,913 | 3/1985 | Carmody | 166/319 |
| 4,527,631 | 7/1985 | Vazquez | 166/324 X |
| 4,569,398 | 2/1986 | Pringle | 166/323 X |

*Primary Examiner*—Stephen J. Novosad
*Assistant Examiner*—David J. Bagnell
*Attorney, Agent, or Firm*—Fulbright & Jaworski

[57] ABSTRACT

A subsurface well safety valve having a flow tube telescopically movable in a housing for controlling the movement of a valve closure member. A piston and cylinder assembly actuates the flow tube and is in communication with hydraulic control fluid from the well surface on one side and a gas biasing chamber on the second side and includes a spring acting on the flow tube to close the valve. An equalizing system equalizes fluid pressure on opposite sides of the piston and cylinder assembly in the event of a failure in the seal between the piston and cylinder thereby allowing the spring to close the valve.

12 Claims, 6 Drawing Figures

FAILSAFE GAS CLOSED SAFETY VALVE

BACKGROUND OF THE INVENTION

It is well known to use a subsurface safety valve as disclosed in U.S. Pat. Nos. 3,782,461 and 4,161,219 which is actuated to the open position by the application of hydraulic fluid from the well surface and which is moved to the closed position by biasing means such as an enclosed pressurized gas chamber or a mechanical spring. Hydraulic force is applied to a piston and cylinder assembly and acts against the biasing force of the pressurized gas charge or spring in order to open and hold the safety valve opened. When the hydraulic pressure from the well surface is reduced below a certain value the biasing force acts to close the valve.

However, since the valve is a safety valve, it is imperative that it must close under all circumstances and therefore the biasing closing force must be positive and reliable. In the past, a biased mechanical spring acting to close against a hydraulic piston has been the standard. However, as valves are set deeper in the well pressurized chambers containing compressed inner gas have become the norm. In concept, the gas acts against a piston area to create a closing force much higher than that obtainable with a conventional mechanical spring. However, a failsafe closing safety valve has been more difficult to provide using compressed gas chambers. Seal leakage or failure may occur in the safety valve allowing the compressed biasing gas pressure to escape or a seal may leak allowing high pressure tubing gas to act against and overcome the biasing gas chamber. In such cases, the safety valve will fail to close and cannot accomplish its sole function.

The present invention is directed to a failsafe safety valve utilizing a pressurized gas chamber as a biasing closing force in which an equalizing system is provided for equalizing fluid pressure on opposite sides of the piston and cylinder actuating assembly. In the event of a failure of a seal in the piston and cylinder assembly a small biasing spring can easily close the equalized valve.

SUMMARY

The present invention is directed to a subsurface well safety valve for controlling the fluid flow through a well conduit. The valve includes a housing having a bore with a valve closure member moving between opened and closed positions for controlling the fluid flow through the bore. A flow tube is telescopically movable in the housing for controlling the movement of the valve closure member. A piston and cylinder assembly is positioned in the housing and one of the piston and cylinder is connected to the flow tube for actuating the flow tube. A first side of the assembly is adapted to be in communication with a fluid control passageway to the well surface for receiving hydraulic control fluid. A gas chamber in the housing is in communication with the second side of the assembly and acts on the assembly in a direction to close the valve. Spring means are provided between the housing and the flow tube acting on the flow tube in a direction to close the valve. Seal means are provided between the piston and the cylinder and equalizing means are provided for equalizing fluid pressure on opposite sides of the piston and cylinder assembly in the event of a failure in the seal means for allowing the spring means to close the valve.

Still a further object of the present invention is wherein the equalizing means includes a passageway in the piston and cylinder assembly and means for opening and closing the passageway for equalizing fluid pressure on the piston and cylinder assembly.

Yet a further object of the present invention is wherein pressure responsive means is connected to the opening and closing means for equalizing fluid pressure.

Still a further object of the present invention is wherein the piston and cylinder assembly includes a first piston with first and second spaced seals and the first piston between the spaced seals is in communication with the bore whereby the tubing pressure in the bore is pressure balanced on the piston and cylinder assembly.

Still a further object is wherein the piston includes a passage therethrough, a piston rod telescopically movable in the passageway, and a piston valve means connected to the piston rod for opening and closing the passageway to fluid flow.

Yet a still further object of the present invention is the provision of a second piston having a second passageway and positioned about the piston rod and positioned between one end of the first piston and the valve means and a third piston is positioned at the other end of the first piston and connected to the piston rod by a spring-loaded releasable connection.

Yet a still further object of the present invention is wherein the piston valve is spring urged to an open position, and the spring-loaded releasable connection has a greater spring strength than the spring strength of the piston valve means, and the spring means between the housing and the flow tube has a greater spring strength than the spring strength of the releasable connection.

Yet a still further object of the present invention is wherein the equalizing means includes means allowing passage of fluid from one side of the piston and cylinder assembly to the other side of the piston and cylinder assembly for equalizing fluid pressure on the assembly.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

Figure 1A:
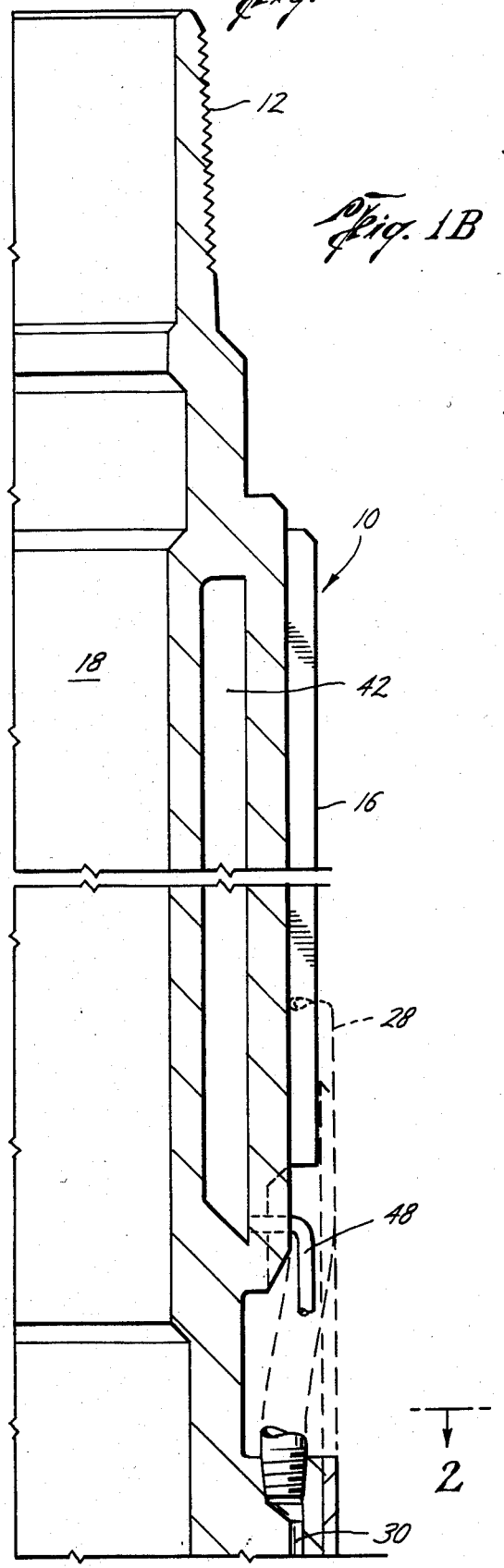
FIGS. 1A, 1B, 1C and 1D are continuations of each other and are an elevational view, in quarter section, of the safety valve of the present invention shown in the open position.

While the present invention in a subsurface well safety valve will be described, for purposes of illustration only, as incorporated in a flapper-type tubing retrievable safety valve, it will be understood that the present invention may be used with other types of safety valves and safety valves having various types of valve closing elements.

Referring now to the drawings, and particularly to FIGS. 1A through 1D, the subsurface safety valve of the present invention is generally indicated by the reference numeral 10 and is shown as being of a non-retrievable type for connection in a well conduit or well tubing such as by a threaded pin 12 at the top and a threaded pin 14 at the bottom. The valve 10 generally includes a body or housing 16 adapted to be connected in a well tubing to form a part thereof and to permit well production therethrough under normal operating conditions but in which the safety valve 10 may close or be closed when desired or in response to abnormal conditions.

Figure 1B:
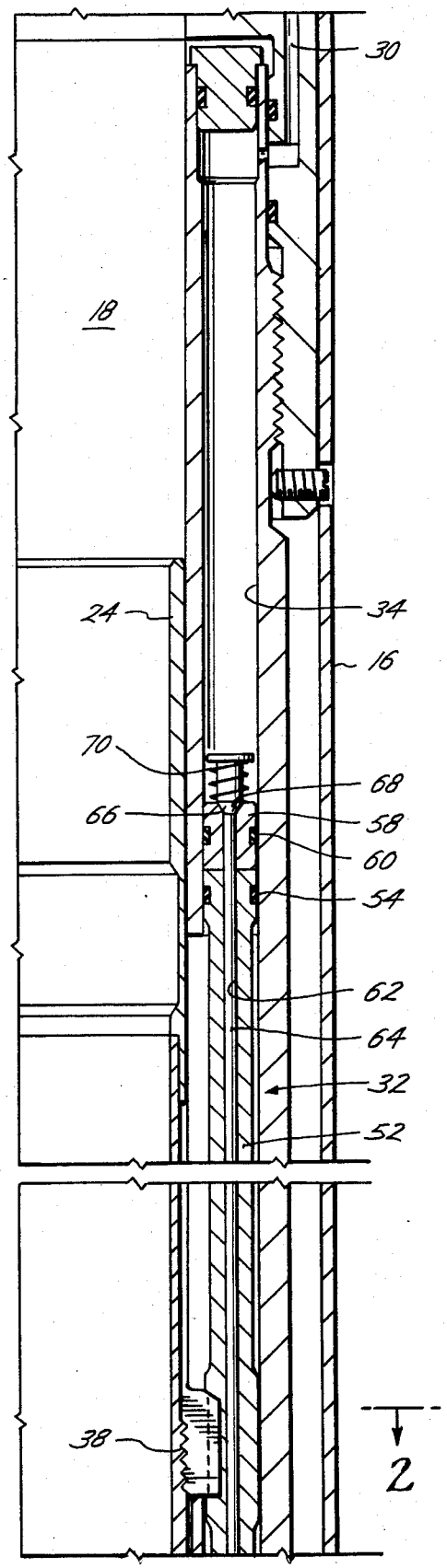
Figure 1C:
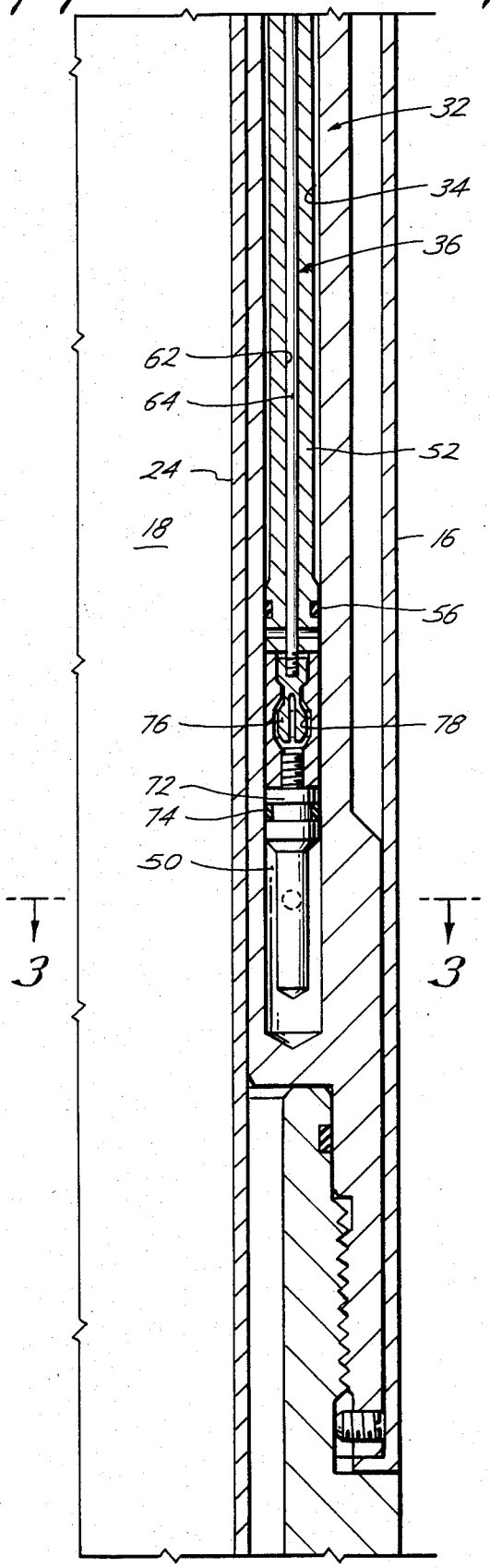
Figure 1D:
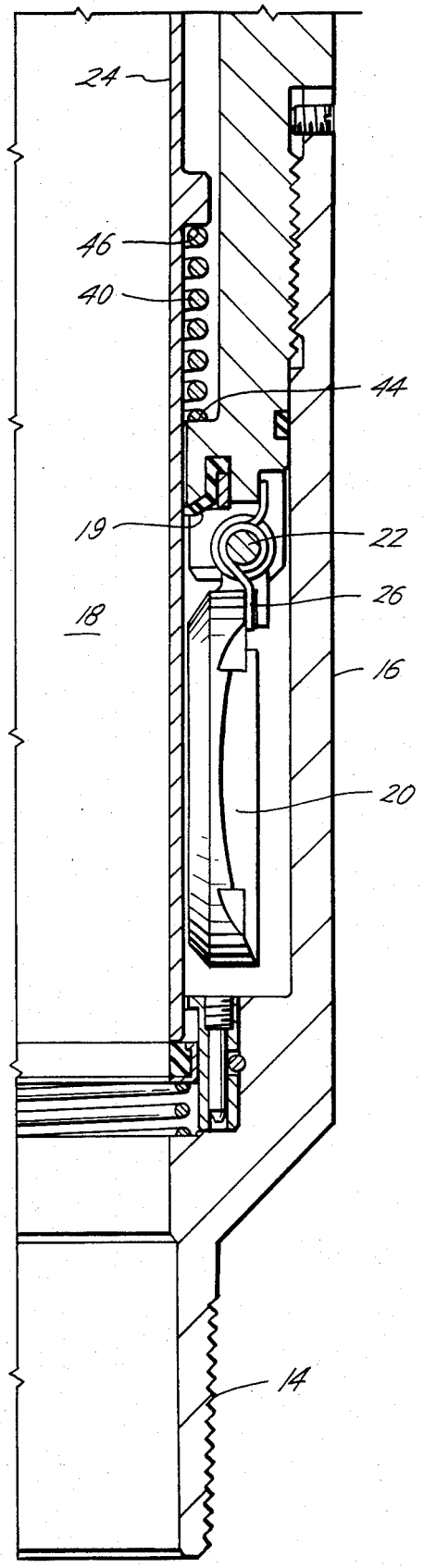
Figure 2:
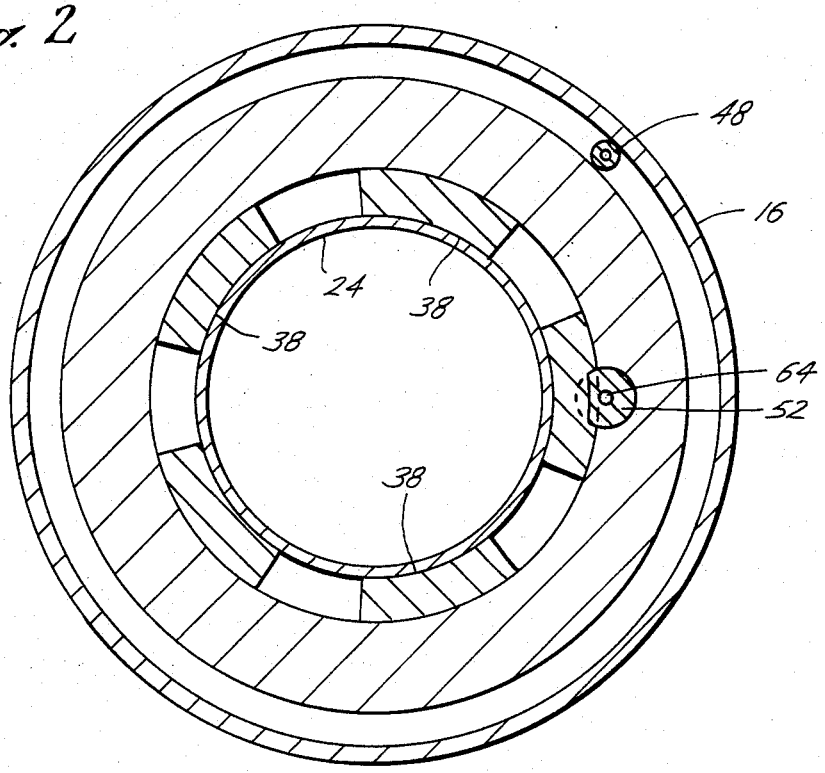
FIG. 2 is a cross-sectional view taken along the line 2—2 of FIG. 1B.
Figure 3:
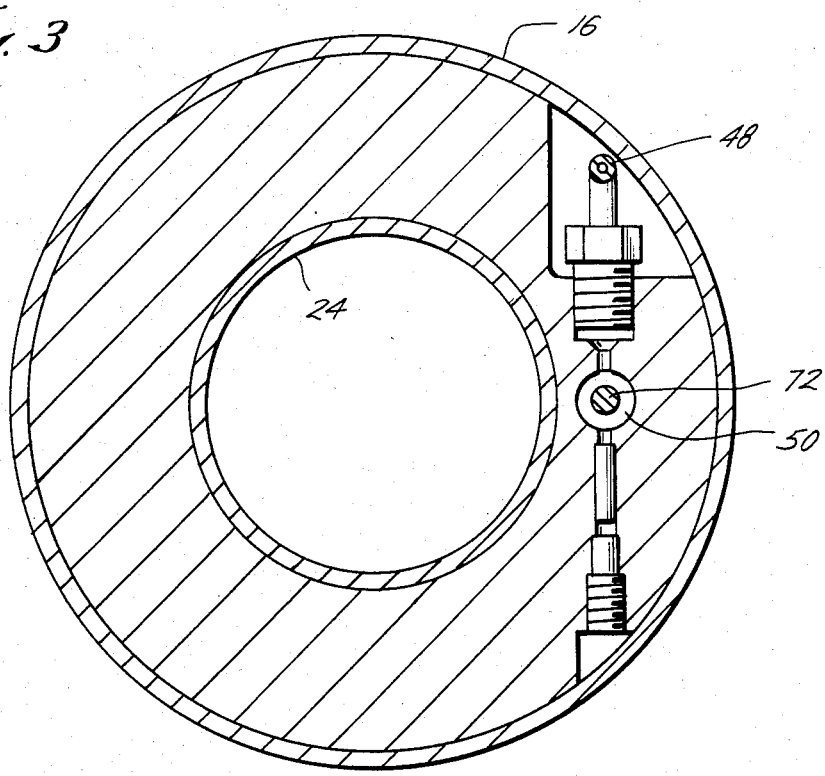
FIG. 3 is a cross-sectional view taken along the line 3—3 of FIG. 1C.

The valve 10 includes a bore 18, and as best seen in FIG. 1D, an annular valve seat 19 positioned about the bore 18, a valve closure element or flapper valve 20 connected to the body 16 by a pivot pin 22. When the valve closure member 20 is in the upper position and seated on the valve seat 19, the safety valve 10 is closed blocking flow upwardly through the bore 18 and the well tubing.

A tubular member or flow tube 24 is telescopically movable in the body 16 and through the valve seat 19. When the flow tube 24 is moved to a downward position the tube 24 pushes the flapper 20 away from the valve seat 19. Thus the valve 10 is held in the open position so long as the flow tube 24 is in the downward position. When the flow tube 24 is moved upwardly, the flapper valve 20 is allowed to move upwardly on to the seat 19 by the action of a spring 26.

The safety valve 10 is controlled by the application or removal of a pressurized fluid, such as hydraulic fluid, through a control path or line such as control line 28 which extends to the well surface or the casing annulus to supply a pressurized hydraulic fluid to a passageway 30 to the top of a piston and cylinder assembly generally indicated by the reference numeral 32 (FIGS. 1B and 1C) which generally includes a cylinder generally indicated by the reference numeral 34 and a piston system generally indicated by the reference numeral 36. One of the piston 36 and cylinder 34 is connected to the flow tube 24, such as the piston 36, by a threaded connection 38. Therefore, the application of a pressurized hydraulic fluid to the top or first side of the piston and cylinder assembly 32 will move the flow tube 24 downwardly forcing the flapper valve element 20 off of the seat 19. Biasing means such as a spring 40 and a pressurized gas chamber 42 are provided for yieldably urging the flow tube 24 upwardly in a direction to release the flapper valve element 20 for closing the valve 10. The spring 40 acts between a shoulder 44 on the housing 16 and a shoulder 46 on the flow tube 24. The pressurized gas chamber 42 includes a line 48 and compartment 50 which is in communication with the second side of the piston and cylinder 32 assembly and acts on the assembly 32 in a direction to close the valve 10. The pressurized gas in the compartment 50 is the primary and main force for moving the valve 10 to the closed position when the pressure on the hydraulic fluid in line 28 is reduced.

However, subsurface safety valves which in the past have relied upon compressed gas for valve closure lack efficient means by which the valve closure is substantially fail proof. That is, if the seals holding the pressurized gas fail, then the gas will leak out and fail to provide the closing force when necessary. Additionally, the so-called tubing pressure or well pressure in the bore 18 may in some cases be at a higher pressure than the pressurized gas in the compartment 50. In the event that the higher pressured gas in the bore 18 comes in communication with a seal acting on the compressed gas chamber the tubing pressure can overcome the biasing gas and hold the valve in the open position. The present invention overcomes these problems to provide a substantially failsafe safety valve in which equalizing means are provided for equalizing the fluid pressure on opposite sides of the piston and cylinder assembly 32 in the event of a failure of the seal means thereby allowing the small power spring 40 to close the valve even in the presence of high hydrostatic head forces in the line 30.

Referring now to FIGS. 1B and 1C, the piston system 36 includes a first piston 52 having a first seal 54 and a second seal 56 operable in the cylinder 34. The first piston 52 between the spaced seals 54 and 56 is exposed to pressure in the bore 18 as the fluid pressure in the bore 18 may be in communication with the piston 52 between the unsealed engagement of the flow tube 24 with the inside of the housing 16. This insures that the piston and cylinder assembly 32 is pressure-balanced as to the fluid pressure in the bore 18.

A second piston 58 having a seal 60 is movable in the cylinder 34. The first piston 52 and the second piston 58 include an equalizing passageway 62 through which a piston rod 64 extends. The piston rod 64 is not sealed in the passageway 62 and consequentially fluid flow may flow through the passageway 62 in spite of the presence of the piston rod 64. However, a piston valve means is provided connected to the piston rod for opening and closing the passageway 62 to fluid flow. Thus, a valve element 66 is provided on the piston rod 64 for coacting and seating on a valve seat 68 on the second piston 58 for closing the passageway 62. Spring means 70 are yieldably urged in a direction to unseat the valve element 66 and open the passageway 62 to fluid flow.

Referring now to FIG. 1C a third piston 72 having a piston seal 74 is positioned at the second end of the first piston 52 and is connected to the piston rod 64 by a spring-loaded releasable connection. The releasable connection may be a spring collet 76 connected to the rod 64 and positioned in a tapering cavity 78 in the piston 72. It is to be noted that the collet 76 and cavity 78 allows movement between the piston 72 and the rod 64 in the cylinder 34 upon contraction of the collet 76. In another embodiment, the parts were reversed and the collet fingers were on the outside engaging a knob on the inside.

It is also to be noted that the spring strength of the various operative parts have a definite relative strength. The spring 70 on the piston rod valve has the lowest strength, for example, five pounds of force. The strength of the collet 76 has a spring strength of approximately 20 pounds prior to providing a release, and the power spring 40 has a higher level of spring strength, for example, 40 pounds. The present invention provides a failsafe piston 36 designed to provide a failsafe valve that will close whenever (1) hydraulic fluid operating pressure in the line 28 is reduced, (2) compressed gas pressure in the chamber 42 and compartment 50 is reduced, and/or (3) in the event seal leakage occurs anywhere in the piston system 36.

Generally, the safety valve 10 opens as hydraulic pressure above a specified value is applied to the line 28 leading from the well surface to the piston system 36 moving the piston system 36 in the cylinder 34. The first piston 52 which is connected to the flow tube 24 moves the flow tube 24 downwardly to open the flapper valve element 20 to place the safety valve 10 in the open position. To close the valve 10, hydraulic pressure in the line 28 is decreased below the compressed gas in the chamber 42 and compartment 50 which acts on the piston system 36 to move the piston system 36 upwardly, retracting the flow tube 24 and allowing the flapper 20 to close.

However, more specifically, the hydraulic fluid in the line 28 flows into passageway 30 and into the cylinder 34 and against the top of the second piston 58. Since the piston rod valve is opened by the spring 70, fluid will flow down the passageway 62 through the first piston 52 and act on the third piston 72 which moves downwardly pulling the piston rod 64 downwardly to seat the piston rod element 66 on the valve seat 68 to close the passageway 62. Thereafter, additional hydraulic operating pressure acts only across the second piston 58 to drive the piston system 36 downwardly to open the valve.

There are various possible ways that closure could occur even in the event of a failure:

Event 1. Normal closure

When the hydraulic operating pressure is removed or decreased sufficiently, the gas charge in the compartment 50 acts upwardly against the third piston 72 moving it upwardly and pushing the first piston 52 upwardly which in turn moves the flow tube 24 upwardly and closes the valve.

Event 2. In which gas leaks out of compartment 50

If seal 74 on piston 72 fails or otherwise gas leaks out of the compartment 50, the gas pressure in the compartment 50 will be reduced, but, of course, will not be reduced any less than the pressure being applied on the top of the piston assembly 36. Thereafter, by reducing the hydraulic pressure in the line 28, the pressure above the piston system 36 is reduced until it equals the now reduced gas pressure in the compartment 50. This will allow the spring 70 in the piston rod valve to unseat the valve element 66 from the seat 68 thereby allowing the hydraulic fluid in the cylinder 34 to move through the equalizing passageway 62 and be applied against the bottom ends of the first piston 52 and the second piston 58 thereby placing the entire piston system 36 in equilibrium regardless of the hydrostatic head existing in the conduit 28. That is, the pressure on both sides of each piston 52, 58 and 72 are equal. Because of this existing equilibrium, the spring 40 may now lift the flow tube 24 and piston assembly 36 upwardly through the hydraulic fluid in the cylinder 34 thereby closing the safety valve 10. It is to be particularly noted that the spring 40 is not required to be the conventional high power mechanical spring previously used in subsurface safety valves for closure, but need only be sufficient to overcome the forces of gravity and friction acting on the flow tube 24 and piston assembly 36 and may have only a small force, such as for example, 40 pounds.

Event 3. Failure of seal 60 on second piston 58

In this case hydraulic fluid flow would bypass seal 60, move between the first piston 52 and the second piston 58 and into the equalizing passageway 62 to move therethrough and act on the third piston 72. Thus, the hydraulic pressure on first piston 52 and second piston 58 is in equilibrium and the gas pressure in the chamber 50 will close the valve 10 by moving the piston assembly 36 upwardly.

Event 4. In which the seal 54 or seal 56 on the first piston 52 fails A. First, assuming that the pressure in the gas compartment 50 is greater than the fluid pressure in the bore 18, while the bore or tubing pressure will flow and act against the top of the third or lower piston 72, the valve 10 will close as normal as described in Event 1 above, upon a decrease in the hydraulic fluid pressure in the control line 28.

B. However, if the pressure charge in the chamber 50 is less than the pressure of the fluid in the bore 18, the bore pressure will enter the passageway 62 around the leaking seal and act on the lower or third piston 72. This acts to separate the third piston 72 from the first piston 52 and release the connection 76 and 78 thereby allowing the piston rod valve spring 70 to move the piston rod valve element 66 off of its seat 68 and open the passageway to hydraulic fluid in the cylinder 34. This again equalizes the fluid pressure across the first 52 and second piston 58 and the third piston 72 has been disconnected thereby allowing the spring 40 to again lift the flow tube 24 and the balanced pistons 52 and 58 to close the valve.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A subsurface well safety valve for controlling the fluid flow through a well conduit comprising, a housing having a bore, a valve closure member moving between open and closed positions for controlling the fluid flow through the bore, a flow tube telescopically moving in the housing for controlling the movement of the valve closure member, a piston and cylinder assembly positioned in the housing and one of the piston and cylinder engages the flow tube, a first side of the assembly adapted to be in communication with a fluid control passageway to the well surface, a gas chamnber in the housing in communication with the second side of the assembly acting on the assembly in a direction to close said valve, spring means between the housing and the flow tube acting on the flow tube in a direction to close said valve, seal means between the piston and cylinder, and openable and closable equalizing means for equalizing fluid pressure on opposite sides of the piston and cylinder assembly in the event of a failure in the seal means thereby allowing the spring means to close the valve.

2. The apparatus of claim 1 wherein the equalizing means includes a passageway in the piston and cylinder assembly, and means for opening and closing said passageway.

3. The apparatus of claim 2 including pressure responsive means connected to the opening and closing means.

4. The apparatus of claim 1 wherein the piston and cylinder assembly includes a first piston with first and second spaced seals, said first piston between the spaced seals being in communication with the bore.

5. The apparatus of claim 4 wherein said piston includes a passageway therethrough, a piston rod telescopically movable in the passageway, and a piston valve means connected to the piston rod for opening and closing said passageway to fluid flow.

6. The apparatus of claim 5 including, a second piston having a second passageway and positioned about the piston rod and positioned between one end of the first piston and the valve means, and a third piston positioned at the other end of the first piston and connected to the piston rod by a spring-loaded releasable connection.

7. The apparatus of claim 6 wherein the piston valve means is spring urged to an open position.

8. The apparatus of claim 7 wherein the spring-loaded releasable connection has a greater spring strength than the spring strength of the piston valve means.

9. The apparatus of claim 8 wherein the spring means between the housing and the flow tube has a greater spring strength than the spring strength of the releasable connection.

10. The apparatus of claim 1 wherein the pressure in the gas chamber has a greater closing force on the valve than the spring means.

11. The apparatus of claim 1 wherein the equalizing means includes means allowing the passage of fluid from one side of the piston and cylinder assembly to the other side of the assembly for equalizing fluid pressure on the assembly.

12. A subsurface well safety valve for controlling the fluid flow through a well conduit comprising, a housing having a bore, a valve closure member moving between open and closed positions for controlling the fluid flow through the bore, a flow tube telescopically moving in the housing for controlling the movement of the valve closure member, a piston and cylinder assembly positioned in the housing and one of the piston and cylinder engages the flow tube, a first side of the assembly adapted to be in communication with a fluid control passageway to the well surface, a gas chamber in the housing in communication with the second side of the assembly acting on the assembly in a direction to close said valve, spring means between the housing and the flow tube acting on the flow tube in a direction to close said valve, seal means between the piston and cylinder, and equalizing means for equalizing fluid pressure on opposite sides of the piston and cylinder assembly in the event of a failure in the seal means including, said piston and cylinder assembly includes a first piston with first and second spaced seals, said first piston between the spaced seals being in communication with the bore, a second piston positioned above the first piston, and a third piston positioned below the first piston, an equalizing passageway extending through said first and second pistons, a piston rod telescopically movable in the passageway piston valve means connected to the piston rod for opening and closing said passageway to fluid flow, and said third piston connected to the piston rod by a releasable connection.

* * * * *